United States Patent [19]

Kivimaa et al.

[11] Patent Number: 4,959,527

[45] Date of Patent: Sep. 25, 1990

[54] ELECTRIC SAUNA HEATER

[75] Inventors: Antti Kivimaa, Kauniainen; Reijo Perälä, Hangonkylä, both of Finland

[73] Assignee: Oy Helo-Tehtaat-Helo Factories, Ltd., Helsinki, Finland

[21] Appl. No.: 292,230

[22] Filed: Dec. 30, 1988

[30] Foreign Application Priority Data

Dec. 31, 1987 [FI] Finland ..... 875786

[51] Int. Cl.[5] ..... F24H 7/06; A61H 33/06

[52] U.S. Cl. ..... 219/365; 4/524

[58] Field of Search ..... 219/365, 378, 364, 492; 4/524

[56] References Cited

U.S. PATENT DOCUMENTS

| | | | |
|---|---|---|---|
| 3,275,800 | 9/1966 | Kuoppamaki et al. | 219/364 |
| 3,309,503 | 3/1967 | Dow et al. | 219/378 |
| 3,368,061 | 2/1968 | Lahti | 219/378 |
| 3,892,946 | 7/1975 | Rimmi | 219/364 |
| 4,121,570 | 10/1978 | Schneider et al. | 219/364 |
| 4,446,356 | 5/1984 | Rimmi | 219/365 |
| 4,851,646 | 7/1989 | Perälä | 219/378 |

FOREIGN PATENT DOCUMENTS

| | | | |
|---|---|---|---|
| 2427625 | 1/1975 | Fed. Rep. of Germany | 219/364 |
| 3021312 | 12/1980 | Fed. Rep. of Germany | 219/365 |
| 132871 | 11/1972 | Finland . | |
| 57880 | 7/1977 | Finland . | |
| 66532 | 10/1983 | Finland . | |
| 844362 | 5/1986 | Finland . | |
| 845009 | 6/1986 | Finland . | |
| 853106 | 2/1987 | Finland . | |
| 74207 | 9/1987 | Finland . | |
| 87/03194 | 6/1987 | PCT Int'l Appl. . | |

*Primary Examiner*—A. D. Pellinen
*Assistant Examiner*—Geoffrey S. Evans
*Attorney, Agent, or Firm*—Brumbaugh, Graves, Donohue & Raymond

[57] ABSTRACT

An electric sauna heater comprising an outer casing surrounding a stone space containing heat-storing material, and at least one electric resistor provided in the stone space for heating the heat-storing material. In order to provide an electric sauna heater in which the required preheating time, the energy consumption, and the steam generating properties are advantageous, the outer casing is thermally insulated and surrounds the stone space substantially tightly at least on the sides and at the top. Electric power supply to the electric resistor(s) is effected in dependance of the temperature in the stone space so that by forming air flow connection between the stone space and the room where the sauna heater is positioned the room can, when desired, be warmed up ready for a sauna bath.

13 Claims, 2 Drawing Sheets

4
TEMPERATURE LIMITER
15
12 SWITCH
STONE SPACE THERMO-STAT
11
13 TIMER
14
17 ROOM THERMOSTAT
N
L
1
2
3
4
16

ELECTRIC SAUNA HEATER

This invention relates to an electric sauna heater comprising an outer casing surrounding a stone space containing heat-storing material, and at least one electric resistor arranged in the stone space for heating the heat-storing material.

When aiming at improving electric sauna heaters and the properties thereof, it has generally been regarded as important that the steam bath provided by the heater is pleasant to the bather, that the heater is easy to operate, and that the energy consumption of the heater is kept low. Herein the ease of operation of the electric sauna heater implies on one hand that its control means are easy to operate and on the other hand that the heater is able to raise temperature in the sauna room sufficiently in a sufficiently short time. A long preheating time is not advisable because it requires that the bathing decision should be made in good time before the planned bathing. However, to achieve a short preheating time, the electric power of the heater should be very high, which in turn means a high energy consumption and does not necessarily affect favorably the pleasantness of the steam bath. Such an increase in the electric power and a rapid heating of the heater, however, are completely contradictory to the general opinion that the most pleasant bathing conditions are obtained by means of a "traditional" heat-storing sauna heater containing plenty of heat-storing material. Thereby the heat is pleasantly humid and the temperature in the sauna room does not usually rise to any high value while the great number of stones ensures that the steam generating capacity is sufficient.

Previous attempts made to achieve these somewhat conflicting aims in the same sauna heater have not been successful, and in practice the sauna heaters are of two types: heat-storing ones requiring a very long preheating time and continuously heated ones.

The object of the present invention is, however, to provide an electric sauna heater by means of which all the above-mentioned aims are obtained in one and the same heater without the exclusion of any one of them. This is achieved by means of an electric sauna heater according to the invention in which the outer casing is thermally insulated and surrounds the stone space substantially tightly at least on the sides and at the top; the stone space comprises means for effecting power supply to the electric resistor(s) in dependance of the temperature in the stone space; and the heater comprises means for forming air flow connection between the stone space and the room where the sauna heater is positioned for transferring heat from the stone space into the room where the heater is positioned. In one embodiment of the invention, the means for providing an air flow connection preferably comprise an openable lid and at least one in-flow opening for air in the lower portion of the heater, whereby the in-flow openings may be provided with a door adjusting the in-flow area of the opening.

To ensure safety in operation, it is preferable that the means for providing air flow connection comprise a device which positively switches on safety means required for preventing overheating or other such risks when the air flow connection is achieved. In a realization simple in structure, such a device for switching on the safety means disconnects power supply to the electric resistor(s). In this case the device is preferably a switch responsive to the opening of the lid of the heater.

If desired, a timer can be provided in parallel with this switch, so that power can be supplied to the heating resistors for a limited period of time even when the lid is open.

Alternatively, the device for switching on the safety means may connect the electric resistor(s) in series with the timer and/or thermostat means sensing the temperature of the air in the sauna room. When the air flow connection is open, the operation of the sauna heater according to the invention corresponds substantially to that of conventional electric sauna heaters with a large stone space.

In the sauna heater according to the invention, the stone space is substantially tightly surrounded with a heat-insulated outer casing both on the sides and at the top, and the stone space is provided with means for maintaining the temperature in the stone space at a desired value varying from about 400° to about 500° C., for instance. Consequently the heat losses of the heater are very small when the means forming the air flow connection in the heater are closed. In practice, this implies that even though the heating resistors of the heater would be permanently supplied with electricity, the temperature in the room where the heater is positioned will not rise e.g. above the normal room temperature, if desired. Thereby it is possible to heat the room where the heater is positioned in a controlled way when the sauna room is not being used for bathing by very simple means such as a room thermostat, an adjustable opening or a small blower or the like provided in the stone space or the like means known in connection with heaters retaining heat in heat-storing material.

The most epoch-making advantage of the electric sauna heater according to the invention is that the sauna is practically always ready for bathing. Merely by opening the lid of the heater, the temperature in the sauna room can be raised to the normal bathing temperature in a few minutes. If desired, and particularly in sauna rooms of exceptionally large volume, it is also possible to provide the sauna heater with special means for rapidly heating the air in the sauna room when initiating the bathing. Such special means include extra heating resistors intended for heating either the stone space or merely the air and eventually connected with suitable air ducts for boosting the air flow through the stone space of the heater.

In view of the energy consumption, a further advantage of the sauna heater according to the invention is that no appreciable amounts of energy are wasted on the heating of the wall and floor structures or on ventilation during the heating. Further, the electric power of the electric heater according to the invention can be so low that the heater can be connected to a power supply line provided with a single fuse of 10 A or 16 A. As a consequence, the heater can be used in the countryside even at remote points of a power supply system and, for instance, in summer cottage saunas which are seldom provided with a threephase connection required for conventional sauna heaters. Having a structure enabling efficient storage of heat, the sauna heater can also be controlled in such a way that it is mainly heated by so called night current. Similarly it can be readily connected so as to be controlled by a mains instruction device, because the steam generating capacity of the sauna heater is not affected in any greater degree if a break as long as a few hours occurs in the supply of electricity.

The bathing conditions provided by the sauna heater according to the invention when the heater is permanently connected to the mains, are such as preferred by users in general, that is, the sauna heater provides a steam bath similar to that provided by a traditional heat-storing sauna heater with a large stone space whenever desired without having to heat the sauna in advance. As already mentioned above, the large amount of the heat-storing material in the sauna heater makes it possible to switch off the current from the heating resistors of the heater when the heater is began to be used, i.e., when the lid of the heater is opened. Thereby the water to be thrown on the stones will not come into contact with extremely hot metal surfaces, which is regarded as an advantage by some bathers.

BRIEF DESCRIPTION OF THE DRAWINGS

In the following the electric sauna heater according to the invention will be described in more detail with reference to the attached drawings, wherein

FIG. 1 shows a cross-section of the basic embodiment of the electric sauna heater according to the invention in a front view. The heater comprises an outer casing 1 which is thermally insulated substantially on all sides. Part of the outer casing forms an openable lid 2 provided with a hinge 10 at the back. The outer casing 1 surrounds substantially tightly a stone space 3 also on the sides. The stone space 3 is filled with heat-storing material 8, in the form of e.g. sauna stones, as shown in FIG. 1. Electric resistors 4 and an installation pipe 5 for a thermostat 11 sensing the temperature in the stone space are fitted in the stone space. Below the stone space there is provided an air flow duct 6 from where air is able to flow through the stone space 3 when the lid 2 is open. As appears from FIG. 2, a door 9 is provided in front of the air flow opening 6. The door may be adjustable for adjusting the in-flow area of the air flow opening 6. The temperature in the sauna room can be adjusted e.g. by means of this adjustable door 9 during bathing. The electric resistors 4 as well as the installation pipe 5 for the thermostat 11 extend up to a connection box 7 attached to the sauna heater for the required electrical connections.

Figure 3:
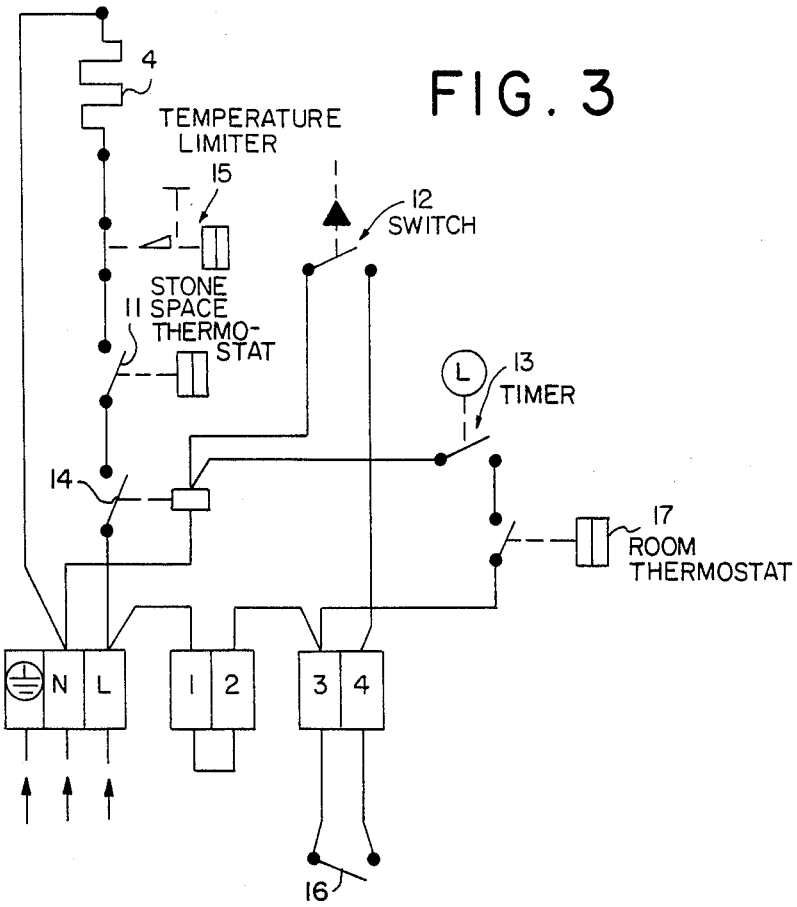
FIG. 3 shows the general circuit diagram of the sauna heater of FIGS. 1 and 2.

Furthermore, a switch 12 responsive to the opening of the lid 2 is provided in the sauna heater. The switch may be arranged to control means for causing a "boosted discharge" for heating the sauna room as rapidly as possible (will be described below). In the simplest embodiment, the circuit diagram of which is shown in FIG. 3, the switch is arranged to disconnect power supply to the electric resistors 4 when the lid 2 of the heater is opened. However, if the heater is to be heated also when the lid 2 is open, the switch can be shunted by a timer 13 which is arranged in the connection box 7. Thermostat 17 senses the temperature of the air in the sauna room.

Figure 1:
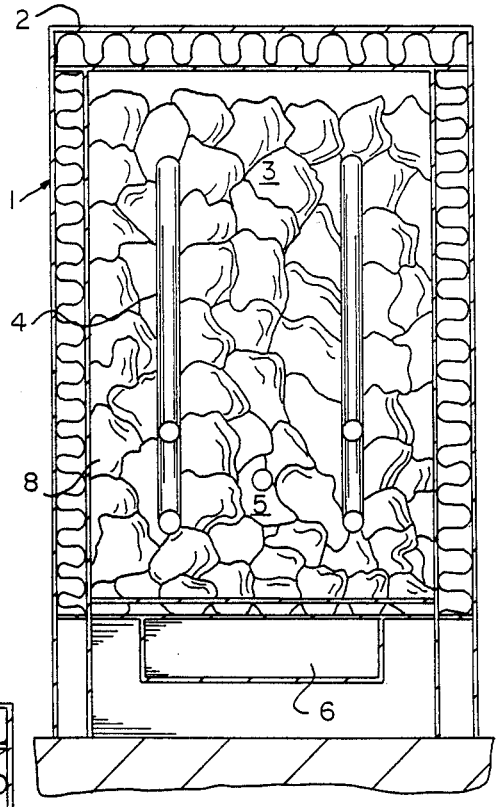
FIG. 1 is a general front view in cross-section of the structure of the basic embodiment of the electric sauna heater according to the invention.
Figure 2:
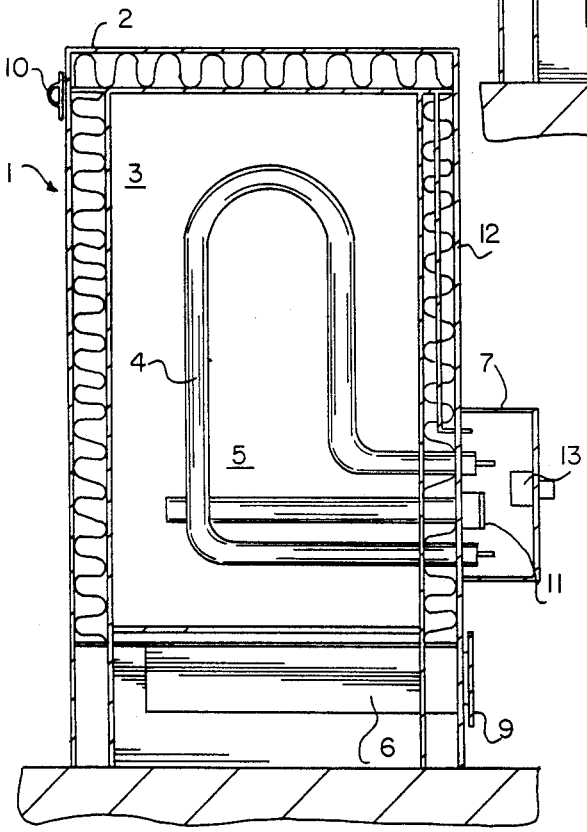
FIG. 2 is a side view in cross-section of the sauna heater of FIG. 1, the heat-storing material being not shown for the sake of clarity.

FIG. 3 shows the general circuit diagram of the electric sauna heater according to the invention. The structural parts corresponding to those mentioned in connection with FIGS. 1 and 2 are indicated with the same reference numerals as in these figures. It can be seen from the circuit diagram of FIG. 3 that when the switch 12 responsive to the closing of the lid 2 of the heater is closed, it keeps a contactor 14 closed, whereby the heating resistor 4 of the sauna heater is supplied with power through the contactor 14, the thermostat 11 responsive to the temperature of the stone space, and a temperature limiter 15. It should be noted that since the function of the thermostat 11 is to keep the stone space at a substantially constant temperature, it is also possible to omit this thermostat if the heating resistor 4 is self-adjustable so that its thermal power decreases with rising temperature, whereby the constant temperature can be obtained without a separate thermostat as well. In the circuit diagram of FIG. 3, the reference numeral 16 indicates a possible control switch such as a week timer or the like control means for disconnecting the power supply to the sauna heater during desired periods of time, in view of the use of night current, for instance. When the sauna heater is in its heat-storing state, the switch is normally closed. Thereby a timer 13 is provided in parallel with the switch 12, which timer switches power to the heating resistor 4 even when the switch 12 is open; in practice, when the lid 2 of the heater is open. As mentioned above, the sauna heater according to the invention can also be connected so as to be controlled by a mains instruction device, whereby such a control is connected in place of the short circuit drawn between terminals 1 and 2.

Since the sauna heater according to the invention is usually permanently connected to the mains, it does not necessarily have to comprise the timer 13 shown in FIG. 3 for the control of the power supply. The timer can be controlled positively so as to be actuated e.g. when the lid 2 is opened, provided that the opening of the lid 2 does not automatically disconnect the power supply to the resistors, as shown in FIG. 3. This kind of timer ensures that the sauna heater will not remain in the "discharge" state for an unreasonably long period of time. During the "discharge" state, the lid 2, for instance, is open, and a risk of fire may be caused. On the other hand, an electric power as low as about 3 kW may alone ensure that the wall and ceiling surfaces of the sauna room will never be warmed up too much. In order to fully eliminate the risk of the surfaces warming up too much, it is also possible to use a conventional thermostat positioned on the wall of the sauna room.

FIGS. 1 to 3 show the basic embodiment of the sauna heater according to the invention. This embodiment does not comprise any means for effecting a "boosted discharge" in the sauna heater when initiating the bathing, perhaps with the exception of the adjustable door 9. If desired, particularly sauna heaters intended for sauna rooms of exceptionally large volume can be provided with additional resistors either in order to heat the stone space or merely to heat the air flowing through the sauna heater after the air flow connection from the stone space into the room where the heater is positioned has been created e.g. by opening the lid 2. Such a power discharge can be effected also by positioning a blower e.g. in the air flow opening 6 or by forming suitable air flow channels within the stone space 3 for making the flow of the air through the stone space 3 more efficient. Such additional special means can be arranged to be actuated either positively e.g. by the switch 12, for instance, when the lid 2 is opened, or by means of some other suitable mechanism or switch.

In the embodiment shown in FIGS. 1 and 2, the installation pipe 5 for the thermostat 11 sensing the temperature in the stone space 3 of the sauna heater is disposed in the lower portion of the sauna heater relatively close to the air flow duct 6. In practice, this provides the advantage that when the lid 2 of the sauna heater is opened, a relatively cool air flow enters the heater relatively close to the thermostat. In principle, this air flow keeps the electric resistors 4 permanently switched on. Accordingly, the thermostat 11 in the installation pipe 5 cannot be used for monitoring the temperature in the sauna room; instead, it can be used for actuating the possible additional means for effecting a boosted discharge because it detects very reliably the opening of the lid 2.

The electric sauna heater according to the invention has been described above by way of example with reference to only one specific embodiment, so it is to be understood that several modifications can be made therein without, however, deviating from the scope of protection defined in the attached claims. Such modifications might be possible particularly in the additional means for effecting the so called boosted discharge when initiating bathing or in the other structural matters such as the position of the connection box 7 and the structure of the means forming the air flow connection between the inner space 3 of the sauna heater and the room the heater is positioned in. So the use of the lid 2 is not necessary if it is not desired to throw water on the stones. Instead, a discharge opening could be formed e.g. by some kind of closable grates which could be positioned anywhere in the upper portion of the outer casing 1 of the sauna heater. It is essential in the sauna heater according to the invention that the side and upper surfaces of the outer casing are substantially tight as well as thermally insulated, whereby the heat losses are insignificant in spite of the high temperature of the heat-storing material 8 contained in the stone space 3. For achieving this object it is further essential that a device monitoring the temperature of the heat-storing material 8 is provided in the stone space. Such a device is also necessary in order to prevent damage to the heater structures and particularly to the electric resistors due to too high temperatures.

I claim:

1. An electric sauna heater for sauna rooms comprising, in combination:

an outer casing having thermally insulated side walls and a thermally insulated top wall defining a space for containing heat-storing material and substantially tightly surrounding said space at least on the sides and at the top;

a heat-storing material contained in said space;

at least one electric resistor disposed within said space in contact with at least some of said heat-storing material for heating the heat-storing material;

means for effecting application of electric power from a power supply to said at least one resistor in dependence on the temperature within said space for maintaining a constant temperature in said space;

means for forming, when desired, a path for air to flow between said space and the room in which the sauna heater is positioned for transferring heat from said space into said room for warming up and making said room ready for a sauna bath; and switching means separate from said means for effecting application of electric power operative responsively to operation of said means for forming a path for the flow of air for connecting safety device means in circuit with said at least one resistor for preventing overheating of the sauna room.

2. An electric sauna heater according to claim 1, wherein the top wall of said casing comprises an openable lid and wherein said means for forming a path for the flow of air comprise said openable lid and at least one opening positioned in the lower portion of the heater for the in-flow of air from the sauna room into said space.

3. An electric sauna heater according to claim 2, wherein the opening for the in-flow of air is covered with a movable door for adjusting the in-flow area of the opening.

4. An electric sauna heater according to claim 1, wherein said switching means for connecting said safety device means includes means for disconnecting said power supply from said at least one electric resistor.

5. An electric sauna heater according to claim 4, wherein said switching means further comprises a timer switch connected in parallel with said means for disconnecting the power supply from said at least one resistor.

6. An electric sauna heater according to claim 1 wherein said means for switching on said safety device means includes a timer switch and means for connecting said at least one electric resistor in series with said timer switch.

7. An electric sauna heater according to claim 1, wherein said means for switching on the safety device means includes thermostat means for monitoring the temperature in the sauna room and means for connecting said at least one electric resistor in series with said thermostat means.

8. An electric sauna heater according to claim 1, wherein said means for switching on the safety device means includes a timer switch, thermostat means for monitoring the temperature in the sauna room and means for connecting said at least one electric resistor in series with said timer switch and said thermostat means.

9. An electric sauna heater according to claim 2, wherein said means for switching on the safety device means is a switch responsive to the opening of said openable lid.

10. An electric sauna heater according to claim 2, wherein said heat-storing material comprises a plurality of sauna stones substantially filling said space.

11. An electric sauna heater for sauna rooms comprising, in combination:

an enclosure open at the bottom having thermally insulated side walls and being closed at the top by a thermally insulated openable lid which is closed except when it is desired to heat the sauna room in which the heater is placed, said enclosure defining a space for containing heat-storing sauna stones;

support means secured to said enclosure and spacing the bottom thereof from a floor;

a plurality of sauna stones substantially filling said enclosure;

at least one electric heating element disposed within said space in contact with at least some of said stones for heating said stones;

means for effecting application of electric power from a power supply to said at least one heating element in dependence on the temperature within said space so as to maintain the temperature within said space substantially constant;

means disposed below the bottom of said enclosure defining a passage for permitting air from the sauna room, upon opening of said lid, to freely circulate through said stones and be discharged from the top of said enclosure for heating the air in the sauna room; and switching means separate from said means for effecting application of electric power for switching on safety device means for preventing overheating of the air in the sauna room.

12. An electric sauna heater according to claim 11, wherein said means defining a passage of air includes means for adjustably controlling the volume of air circulating through said stones.

13. An electric sauna heater according to claim 11, wherein said switching means is a switch operative in response to the opening of said lid.

* * * * *